US007628735B1

(12) United States Patent
Hsu

(10) Patent No.: US 7,628,735 B1
(45) Date of Patent: Dec. 8, 2009

(54) FITNESS EQUIPMENT HAVING THE FUNCTIONS OF A JUMP ROPE AND A DUMBBELL

(76) Inventor: Chi-Kun Hsu, 4, Tien-Yang Lane, Lu Kang Township, Chang Hua Hsien (TW)

( * ) Notice: Subject to any disclaimer, the term of this patent is extended or adjusted under 35 U.S.C. 154(b) by 12 days.

(21) Appl. No.: 11/950,579

(22) Filed: Dec. 5, 2007

(51) Int. Cl.
*A63B 5/20* (2006.01)
*A63B 21/072* (2006.01)
*A63B 21/02* (2006.01)

(52) U.S. Cl. ..... 482/82; 482/108; 482/126

(58) Field of Classification Search ..... 482/81, 482/82, 106, 108, 126; D21/672, 680–682
See application file for complete search history.

(56) References Cited

U.S. PATENT DOCUMENTS 1,666,201 A * 4/1928 Goldstein ..... 482/82
3,363,898 A * 1/1968 Crovello ..... 482/82
4,157,827 A * 6/1979 Winston et al. ..... 482/82
4,647,037 A * 3/1987 Donohue ..... 482/82
4,722,523 A 2/1988 Yang
4,778,173 A * 10/1988 Joutras ..... 482/82
4,801,137 A * 1/1989 Douglass ..... 482/82
5,054,772 A * 10/1991 Winston ..... 482/82
5,135,455 A * 8/1992 King et al. ..... 482/108
5,441,471 A 8/1995 Passer
5,842,956 A * 12/1998 Strachan ..... 482/82
6,648,804 B2 11/2003 Chen
6,866,617 B2 3/2005 Chen
2008/0287273 A1* 11/2008 Ma ..... 482/108

FOREIGN PATENT DOCUMENTS

JP 05200130 A * 8/1993

* cited by examiner

*Primary Examiner*—Loan H Thanh
*Assistant Examiner*—Allana Lewin
(74) *Attorney, Agent, or Firm*—Alan Kamrath; Kamrath & Associates PA

(57) ABSTRACT

A fitness equipment includes a cord having two ends each provided with a handgrip, a cord mounting cap, a mounting sleeve, a snapping member, and two end caps. The mounting sleeve presses and locks the snapping member onto the respective end of the cord. The cord mounting cap receives the mounting sleeve and the snapping member and is removably mounted on the handgrip. Each of the end caps is removably mounted on the handgrip. Thus, each of the two ends of the cord is provided with a handgrip so that the fitness equipment can function as a jump rope, and the handgrip can be used individually to function as a dumbbell after the handgrip is detached from the cord.

16 Claims, 6 Drawing Sheets

FITNESS EQUIPMENT HAVING THE FUNCTIONS OF A JUMP ROPE AND A DUMBBELL

BACKGROUND OF THE INVENTION

1. Field of the Invention

The present invention relates to a fitness equipment and, more particularly, to a fitness equipment to provide sport and exercising effects.

2. Description of the Related Art

A conventional fitness equipment, such as a dumbbell, jump rope and the like, is available for a user to provide sport and exercising effects to the user. However, the conventional fitness equipment only has a single function, thereby limiting the versatility of the conventional fitness equipment.

The closest prior art references of which the applicant is aware were disclosed in U.S. Pat. Nos. 4,722,523; 5,441,471; 6,648,804; and 6,866,617.

BRIEF SUMMARY OF THE INVENTION

In accordance with the present invention, there is provided a fitness equipment, comprising a cord having two opposite ends each provided with a handgrip, a cord mounting cap, a mounting sleeve, a snapping member, and two end caps. The snapping member is made flexible and mounted on the respective end of the cord. The mounting sleeve is mounted on the respective end of the cord and presses the snapping member toward the respective end of the cord to lock the snapping member onto the respective end of the cord. The cord mounting cap is mounted on the respective end of the cord to receive the mounting sleeve and the snapping member therein and removably mounted on the handgrip. Each of the end caps is removably mounted on the handgrip.

The primary objective of the present invention is to provide a fitness equipment having the functions of a jump rope and a dumbbell.

Another objective of the present invention is to provide a fitness equipment, wherein each of the two opposite ends of the cord is provided with a handgrip so that the fitness equipment can function as a jump rope, and the handgrip of the fitness equipment can be used individually to function as a dumbbell after the handgrip is detached from the cord, thereby enhancing the to versatility of the fitness equipment.

A further objective of the present invention is to provide a fitness equipment, wherein the fitness equipment can function as a jump rope by screwing the cord mounting cap onto the handgrip and can function as a dumbbell by unscrewing the cord mounting cap from the handgrip, thereby facilitating a user operating the fitness equipment.

A further objective of the present invention is to provide a fitness equipment, wherein when the mounting sleeve and the snapping member are drawn by the cord to move toward the cord mounting cap, the insertion portion of the mounting sleeve is inserted into the through hole of the cord mounting cap, the locking portion of the mounting sleeve is movable to abutting the wall of the through hole of the cord mounting cap, and the elastic clamping plates of the snapping member are pressed inward by the tapered pressing face of the mounting sleeve to clamp the respective end of the cord, so that the snapping member and the cord are combined together solidly and stably.

A further objective of the present invention is to provide a fitness equipment, wherein the handgrip is provided with a protective strap to facilitate the user holding the handgrip to prevent the handgrip from being detached from the user's hand.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
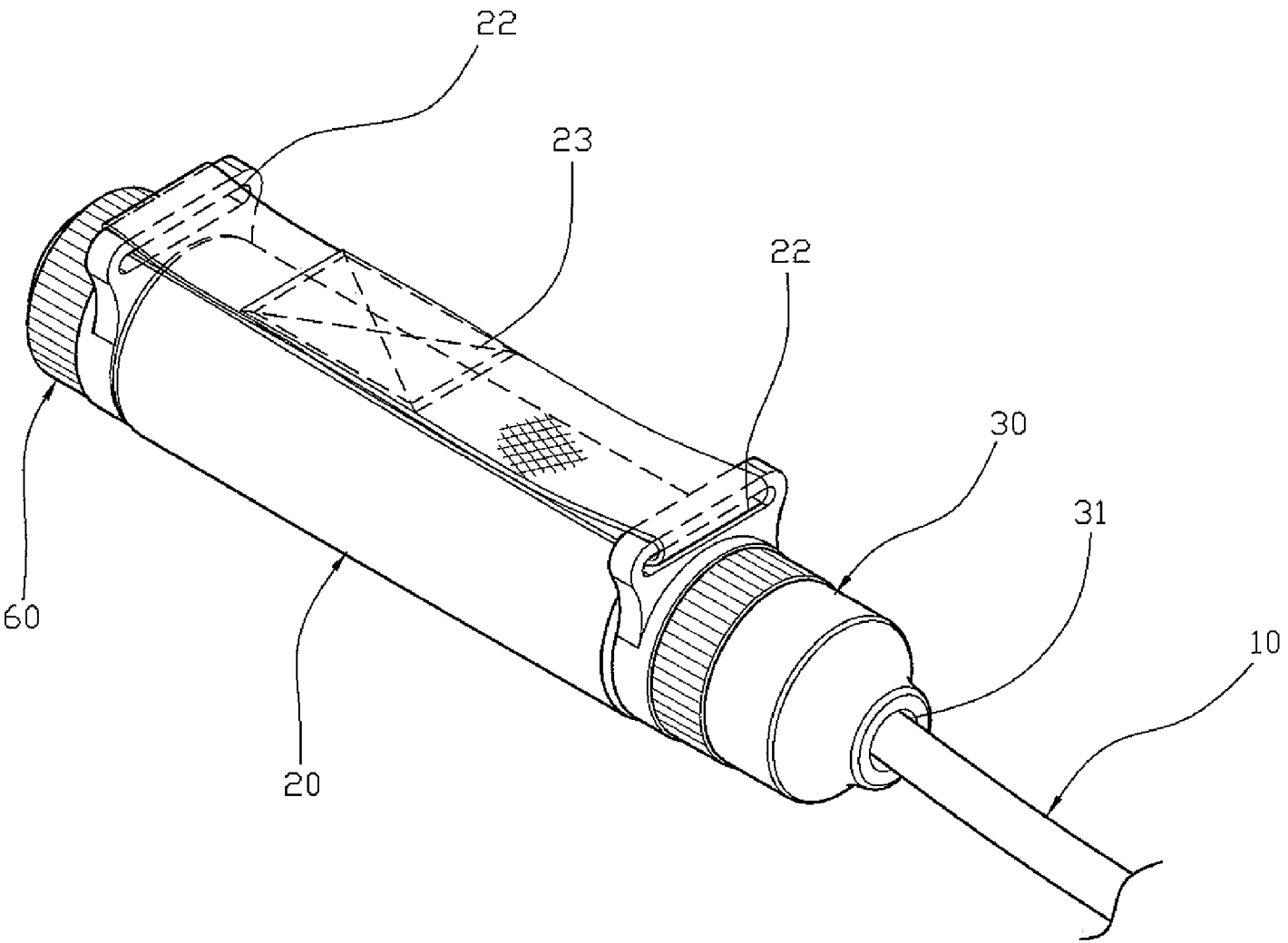
FIG. 1 is a perspective view of a fitness equipment in accordance with the preferred embodiment of the present invention.
Figure 2:
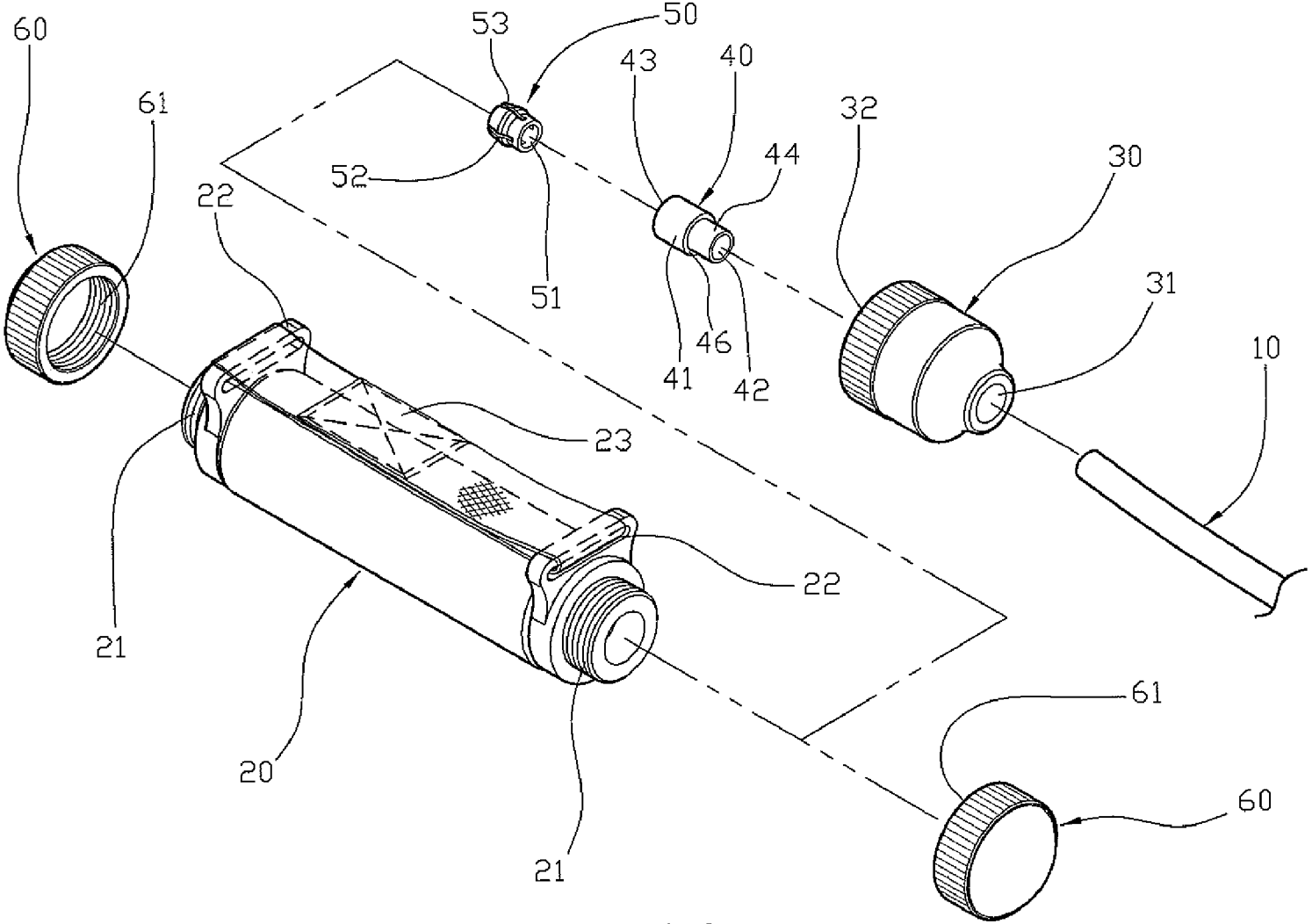
FIG. 2 is an exploded perspective view of the fitness equipment as shown in FIG. 1.
Figure 3:
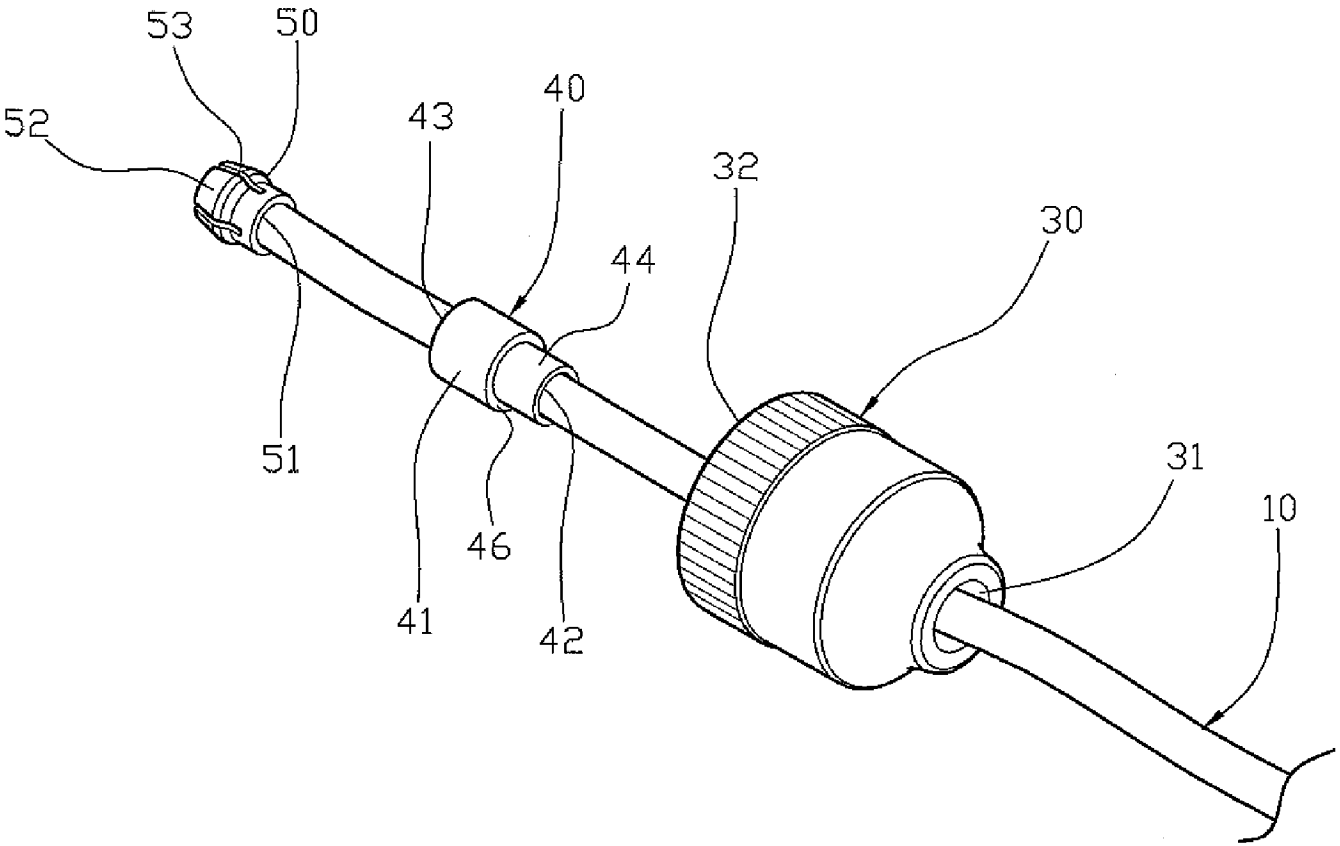
FIG. 3 is a partially perspective view of the fitness equipment as shown in FIG. 1.
Figure 4:
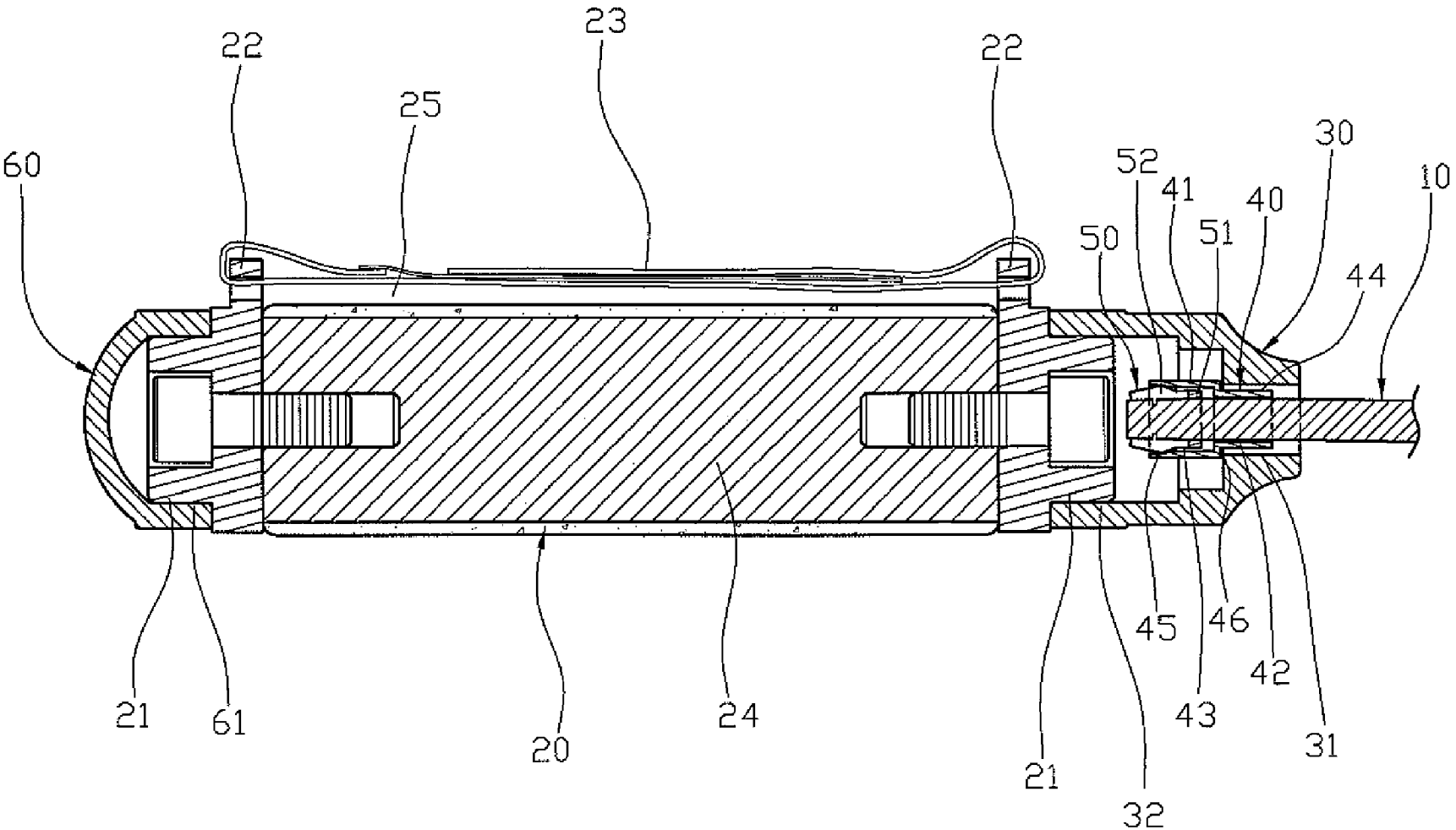
FIG. 4 is a front cross-sectional view of the fitness equipment as shown in FIG. 1.

Referring to the drawings and initially to FIGS. 1-5, a fitness equipment in accordance with the preferred embodiment of the present invention comprises a cord 10 having two opposite ends each provided with a handgrip 20, a cord mounting cap 30, a mounting sleeve 40, a snapping member 50, and two end caps 60. The snapping member 50 is made flexible and mounted on the respective end of the cord 10, the mounting sleeve 40 is mounted on the respective end of the cord 10 and presses the snapping member 50 toward the respective end of the cord 10 to lock the snapping member 50 onto the respective end of the cord 10, the cord mounting cap 30 is mounted on the respective end of the cord 10 to receive the mounting sleeve 40 and the snapping member 50 therein and removably mounted on the handgrip 20, and each of the end caps 60 is removably mounted on the handgrip 20.

The cord 10 is a flexible body and has a circular cross-sectional profile.

The handgrip 20 has a substantially cylindrical shape and has an inside provided with a weight 24 so that the handgrip 20 can be used individually to function as a dumbbell. The handgrip 20 is provided with two opposite protruding threaded posts 21. Each of the two threaded posts 21 is mounted on one of two opposite ends of the handgrip 20 and extends outwardly from the handgrip 20 in a longitudinal direction of the handgrip 20. The handgrip 20 has an outer wall provided with two opposite mounting ears 22 for mounting a protective strap 23, and a gap 25 is defined between the protective strap 23 and the outer wall of the handgrip 20. Each of the two mounting ears 22 extends outwardly from the handgrip 20 in a radial direction of the handgrip 20.

The cord mounting cap 30 has a first end provided with a through hole 31 to allow passage of the respective end of the cord 10 and a second end provided with an inner threaded portion 32 screwed onto one of the two threaded posts 21 of the handgrip 20 to attach the cord mounting cap 30 to the handgrip 20. The inner threaded portion 32 of the cord mounting cap 30 has a diameter greater than that of the through hole 31.

The snapping member 50 has a peripheral wall provided with a plurality of elastic clamping plates 52 pressing the respective end of the cord 10. The peripheral wall of the snapping member 50 is provided with a plurality of longitudinally extending elongate slits 53 to define the elastic clamping plates 52. The snapping member 50 has an inner wall provided with a through bore 51 connected to the elongate slits 53 to allow passage of the respective end of the cord 10.

The mounting sleeve 40 is movably received in the cord mounting cap 30 and has a first end provided with an insertion portion 44 detachably inserted into the through hole 31 of the cord mounting cap 30 and a second end provided with a locking portion 41 pressing the elastic clamping plates 52 of the snapping member 50 to clamp the respective end of the cord 10. The insertion portion 44 of the mounting sleeve 40 has an inner wall provided with a cord bore 42 to allow passage of the respective end of the cord 10. The locking portion 41 of the mounting sleeve 40 has an inner wall provided with a mounting hole 43 to receive the snapping member 50. The mounting hole 43 of the locking portion 41 of the mounting sleeve 40 has a diameter greater than that of the cord bore 42 and has an end portion provided with a tapered pressing face 45 (see FIG. 4) pressing the elastic clamping plates 52 of the snapping member 50 to clamp the respective end of the cord 10. The locking portion 41 of the mounting sleeve 40 has a diameter greater than that of the insertion portion 44 and that of the through hole 31 of the cord mounting cap 30, the insertion portion 44 of the mounting sleeve 40 has a diameter smaller than that of the through hole 31 of the cord mounting cap 30, and the mounting sleeve 40 has a stop shoulder 46 located between the locking portion 41 and the insertion portion 44 and abutting a wall of the through hole 31 of the cord mounting cap 30.

Each of the end caps 60 is provided with an inner threaded section 61 screwed onto a respective one of the two threaded posts 21 of the handgrip 20 to attach each of the end caps 60 to the handgrip 20.

Figure 5:
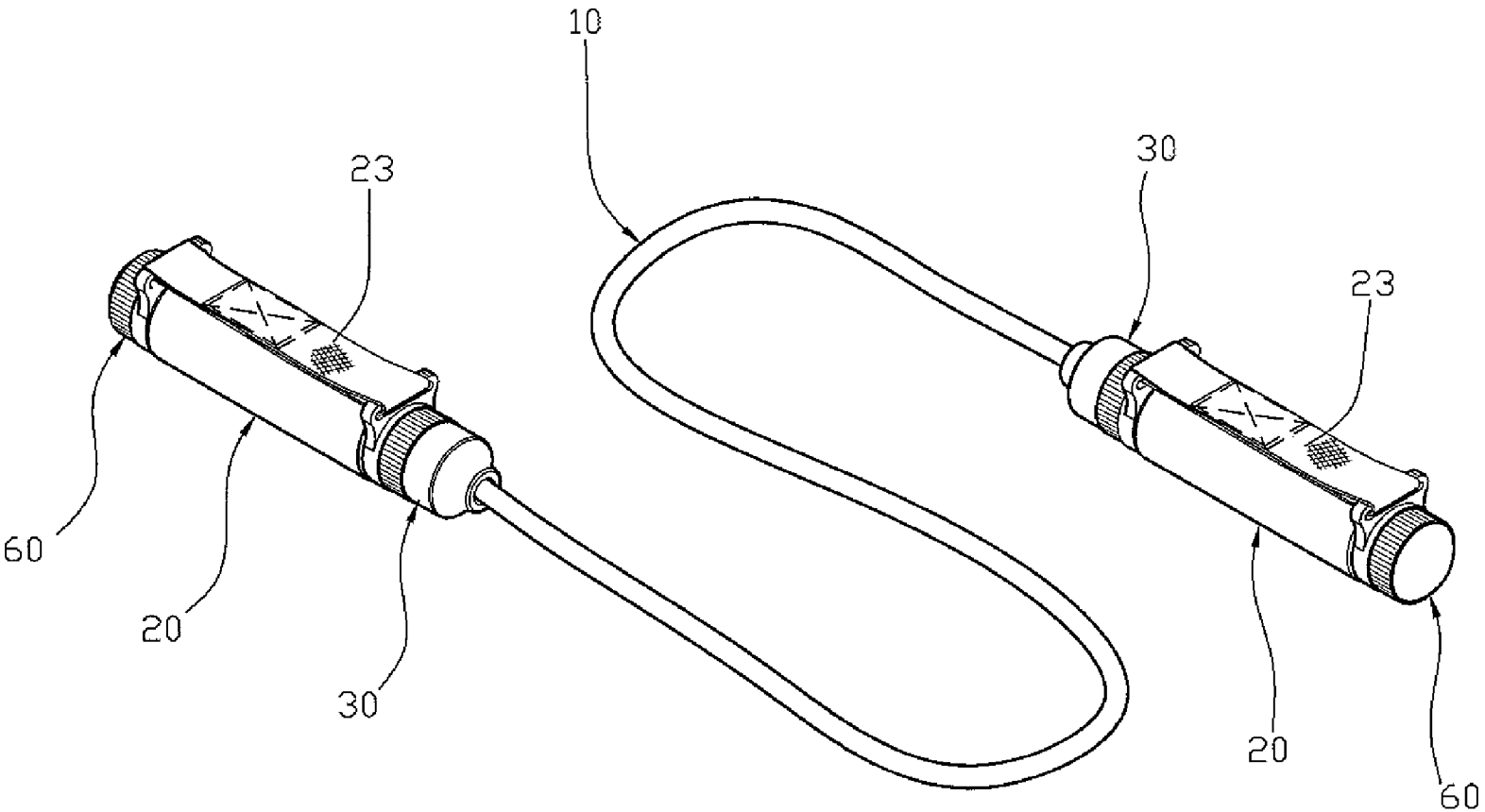
FIG. 5 is a perspective view showing the fitness equipment functioning as a jump rope.

In assembly, referring to FIG. 5 with reference to FIGS. 1-4, the inner threaded portion 32 of the cord mounting cap 30 is screwed onto one of the two threaded posts 21 of the handgrip 20 to attach the cord mounting cap 30 to the handgrip 20, and the inner threaded section 61 of one of the end caps 60 is screwed onto the other one of the two threaded posts 21 of the handgrip 20 to attach the one of the end caps 60 to the handgrip 20. In such a manner, each of the two opposite ends of the cord 10 is provided with a handgrip 20 as shown in FIG. 5, so that the fitness equipment can function as a jump rope.

Figure 6:
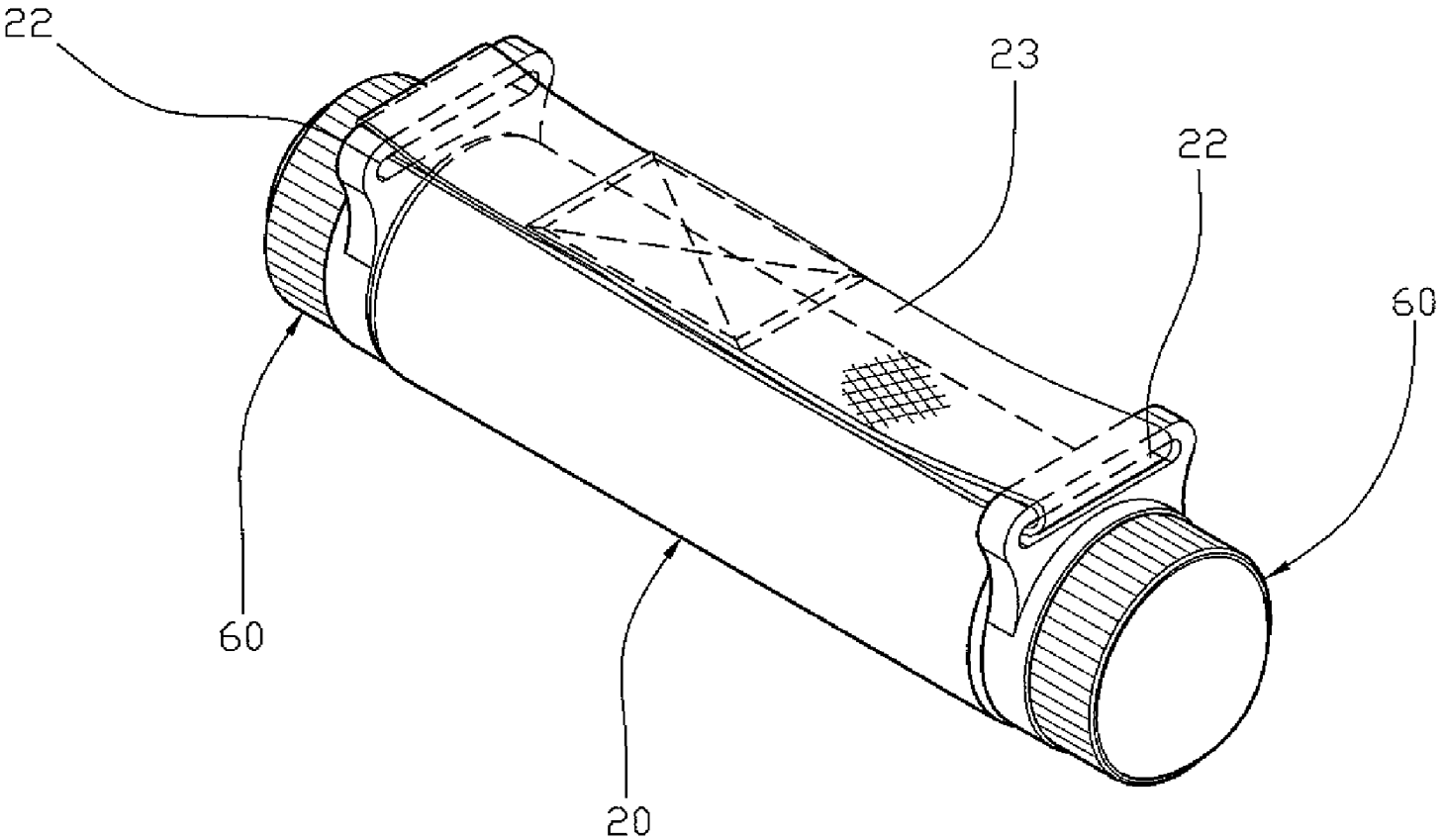
FIG. 6 is a perspective view showing the fitness equipment functioning as a dumbbell.

Alternatively, referring to FIG. 6 with reference to FIGS. 1-4, after the cord mounting cap 30 is removed from the handgrip 20, the inner threaded section 61 of the other one of the end caps 60 is screwed onto the other one of the two threaded posts 21 of the handgrip 20 to attach the other one of the end caps 60 to the handgrip 20. In such a manner, the handgrip 20 is detached from the cord 10 so that the handgrip 20 can be used individually to function as a dumbbell as shown in FIG. 6.

Accordingly, each of the two opposite ends of the cord 10 is provided with a handgrip 20 so that the fitness equipment can function as a jump rope, and the handgrip 20 of the fitness equipment can be used individually to function as a dumbbell after the handgrip 20 is detached from the cord 10, thereby enhancing the versatility of the fitness equipment. In addition, the fitness equipment can function as a jump rope by screwing the cord mounting cap 30 onto the handgrip 20 and can function as a dumbbell by unscrewing the cord mounting cap 30 from the handgrip 20, thereby facilitating a user operating the fitness equipment. Further, when the mounting sleeve 40 and the snapping member 50 are drawn by the cord 10 to move toward the cord mounting cap 30, the insertion portion 44 of the mounting sleeve 40 is inserted into the through hole 31 of the cord mounting cap 30, the locking portion 41 of the mounting sleeve 40 is movable to abutting the wall of the through hole 31 of the cord mounting cap 30, and the elastic clamping plates 52 of the snapping member 50 are pressed inward by the tapered pressing face 45 of the mounting sleeve 40 to clamp the respective end of the cord 10, so that the snapping member 50 and the cord 10 are combined together solidly and stably. Further, the handgrip 20 is provided with a protective strap 23 to facilitate the user holding the handgrip 20 to prevent the handgrip 20 from being detached from the user's hand.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A fitness equipment, comprising:

a cord having two opposite ends each provided with a handgrip, a cord mounting cap, a mounting sleeve, a snapping member, and two end caps; wherein the snapping member is made flexible and mounted on the respective end of the cord;

the mounting sleeve is mounted on the respective end of the cord and presses the snapping member toward the respective end of the cord to lock the snapping member onto the respective end of the cord;

the cord mounting cap is mounted on the respective end of the cord to receive the mounting sleeve and the snapping member therein and removably mounted on the handgrip;

each of the end caps is removably mounted on the handgrip;

the handgrip is provided with two opposite protruding threaded posts;

the cord mounting cap has a first end provided with a through hole to allow passage of the respective end of the cord and a second end provided with an inner threaded portion screwed onto one of the two threaded posts of the handgrip to attach the cord mounting cap to the handgrip.

2. The fitness equipment in accordance with claim 1, wherein the two threaded posts are mounted on one of two opposite ends of the handgrip.

3. The fitness equipment in accordance with claim 1, wherein the two threaded posts extend outwardly from the handgrip in a longitudinal direction of the handgrip.

4. The fitness equipment in accordance with claim 1, wherein the inner threaded portion of the cord mounting cap has a diameter greater than that of the through hole.

5. The fitness equipment in accordance with claim 1, wherein each of the end caps is provided with an inner threaded section screwed onto a respective one of the two threaded posts of the handgrip to attach each of the end caps to the handgrip.

6. The fitness equipment in accordance with claim 1, wherein the handgrip has an outer wall provided with two opposite mounting ears for mounting a protective strap attached to the mounting ears;

a gap is defined between the protective strap and the outer wall of the handgrip.

7. The fitness equipment in accordance with claim 6, wherein the two mounting ears extend outwardly from the handgrip in a radial direction of the handgrip.

8. The fitness equipment in accordance with claim 1, wherein the snapping member has a peripheral wall provided with a plurality of elastic clamping plates pressing the respective end of the cord;

the mounting sleeve is movably received in the cord mounting cap and has a first end provided with an insertion portion detachably inserted into the through hole of the cord mounting cap and a second end provided with a locking portion pressing the elastic clamping plates of the snapping member to clamp the respective end of the cord.

9. The fitness equipment in accordance with claim 8, wherein the peripheral wall of the snapping member is provided with a plurality of longitudinally extending elongate slits to define the elastic clamping plates.

10. The fitness equipment in accordance with claim 9, wherein the snapping member has an inner wall provided with a through bore connected to the elongate slits to allow passage of the respective end of the cord.

11. The fitness equipment in accordance with claim 8, wherein the locking portion of the mounting sleeve has an inner wall provided with a mounting hole to receive the snapping member;

the mounting hole of the locking portion of the mounting sleeve has an end portion provided with a tapered pressing face pressing the elastic clamping plates of the snapping member to clamp the respective end of the cord.

12. The fitness equipment in accordance with claim 11, wherein the insertion portion of the mounting sleeve has an inner wall provided with a cord bore to allow passage of the respective end of the cord.

13. The fitness equipment in accordance with claim 12, wherein the mounting hole of the locking portion of the mounting sleeve has a diameter greater than that of the cord bore.

14. The fitness equipment in accordance with claim 8, wherein the locking portion of the mounting sleeve has a diameter greater than that of the insertion portion and that of the through hole of the cord mounting cap;

the insertion portion of the mounting sleeve has a diameter smaller than that of the through hole of the cord mounting cap;

the mounting sleeve has a stop shoulder located between the locking portion and the insertion portion and abutting a wall of the through hole of the cord mounting cap.

15. The fitness equipment in accordance with claim 11, wherein the when the mounting sleeve and the snapping member are drawn by the cord to move toward the cord mounting cap, the insertion portion of the mounting sleeve is inserted into the through hole of the cord mounting cap, the locking portion of the mounting sleeve is movable to abutting the wall of the through hole of the cord mounting cap, and the elastic clamping plates of the snapping member are pressed inward by the tapered pressing face of the mounting sleeve to clamp the respective end of the cord.

16. The fitness equipment in accordance with claim 1, wherein the handgrip has an inside provided with a weight.

* * * * *